United States Patent [19]

Simon

[11] 4,036,667

[45] July 19, 1977

[54] PROCESS FOR PRODUCING IMPROVED, PROTECTIVE CONVERSION COATINGS ON ALUMINUM AND ITS ALLOYS, WHEREIN ALUMINUM IS THE PRINCIPAL CONSTITUENT

[76] Inventor: Eli Simon, 7175 Little Harbor Drive, Huntington Beach, Calif. 92648

[21] Appl. No.: 696,575

[22] Filed: June 16, 1976

[51] Int. Cl.[2] ..... C23F 7/26

[52] U.S. Cl. ..... 148/6.2; 148/6.27

[58] Field of Search ..... 148/6.2, 6.27

[56] References Cited

U.S. PATENT DOCUMENTS

| | | | |
|---|---|---|---|
| 3,066,055 | 11/1962 | Pimbley | 148/6.2 |
| 3,520,736 | 7/1970 | Newell | 148/6.2 |

*Primary Examiner*—Ralph S. Kendall

[57] ABSTRACT

This invention relates to the use of sodium nitroferricyanide as a substitute for sodium or potassium ferricyanide in nitric acid acidified, hexavalent chromium-fluoride solutions for the treatment of aluminum and its alloys (wherein aluminum is the principal constituent), providing coatings having excellent corrosion-resistance, reduced surface powdering, and improved adhesion and appearance. Small amounts of sodium vanadate may also be added to effectively modify the characteristics of the deposited coatings. Controlled build-up of the protective coatings, produced by chemical reaction between the active components of the solution and the aluminum or aluminum alloy surfaces, are readily accomplished within a temperature range of 65°-85° F. and an immersion time of 5-10 minutes.

1 Claim, No Drawings

PROCESS FOR PRODUCING IMPROVED, PROTECTIVE CONVERSION COATINGS ON ALUMINUM AND ITS ALLOYS, WHEREIN ALUMINUM IS THE PRINCIPAL CONSTITUENT

BACKGROUND AND PRIOR ART

Compositions containing hexavalent chromium, sodium or potassium ferricyanide, and fluoride ion in acidified aqueous solutions have been used for producing corrosion-resistant conversion coatings on aluminum and its alloys. Representative of such compositions are those in U.S. Pat. No. 2,796,370 (patented June 18 1957). I have discovered that by substituting sodium nitroferricyanide(or sodium nitroprusside) for the sodium or potassium ferricyanide, the build-up of the deposit resulting from the reaction between the active components of the solution with the surface of the aluminum and its alloys was much more controlled, substantially eliminating powdering and the formation of porous, loosely-adherent coatings. Additionally, the appearance of the coatings produced by the sodium nitroferricyanide solutions unexpectedly improved in color from a matte, reddish-brown to a semi-glossy, golden yellow.

SUMMARY OF THE INVENTION

This invention discloses that substitution of sodium nitroferricyanide for sodium or potassium ferricyanide in a conversion solution composition of a nitric acid acidified solution of dichromate and a soluble fluoride, reduces the deposition of loosely-adherent reaction products and improves the appearance of the conversion coatings without adversely affecting the corrosion resistance characteristics. This enhances its efficacy for commercial applications and as bonding substrates for finishes such as coatings, adhesives, and sealants. Without being limited to the manner in which the nitroferricyanide salt functions, it may be that a complex anion is formed from the reduced nitroprusside ion, ie., $[Fe^{3+}\cdot(CN)_5NO]^{-2}$ to $[Fe^{2+}(CN)_5NO]^{-3}$ which remains incorporated in the oxidized aluminum coating.

The compositions of this invention are applied at ambient temperatures, within the range of 65–85° F., for immersion times of 5–10 minutes depending on the requirements of color, coating thickness, and corrosion resistance.

Representative compositions of this invention are comprised of from 0.75 to 1.25 gm. of the dihydrate of sodium dichromate, from 0.075 to 0.125 gm. of the dihydrate of potassium fluoride, from 0.075 to 0.125 gm. of the dihydrate of sodium nitroferricyanide $[Na_2Fe(CN)_5.NO2H_2O]$, water to make 100 ml. solution, and nitric acid (70%), if required, to provide a pH of 1.4±0.3. A preferred composition comprises approximately: 1 gm. of the dihydrate of sodium dichromate; 0.1 gm. of the dihydrate of potassium fluoride; 0.1 gm. of the dihydrate of sodium nitroferricyanide; and a pH of 1.5 by addition of 70% nitric acid to 100 ml. of the aqueous solution. It is evident that equivalent concentrations of the active components may be substituted, namely potassium dichromate or chromium trioxide for the sodium dichromate, and sodium fluoride for the potassium fluoride, without invalidating the discovery in the use of sodium nitroferricyanide. The addition of from 0.075 0.125 gm. of the tetrahydrate of sodium vanadate ($NaVO_3\cdot4H_2O$) appears to enhance the efficacy of the invention, particularly as it relates to improved corrosion-resistance in salt water media of the treated aluminum and aluminum alloy substrates.

DESCRIPTION OF THE INVENTION

Experiments were conducted in which sodium nitroferricyanide was substituted for the same weight of potassium ferricyanide(anhyd), with fixed sol'n. weights of the other components. Both aluminum and aluminum alloys, wherein aluminum was the principal constituent, were used as substrates for the conversion coatings, which were applied by total immersion at an ambient temperature of approximately 70° F. for time periods of 1–10 minutes, with intermittent solution agitation. Comparisons were made of the coatings deposited for color, appearance, adhesion, and corrosion protection; additionally, the effects of adding sodium vanadate were noted. The examples set forth will identify some of these considerations.

EXAMPLES OF THE INVENTION

EXAMPLE 1

Characteristics of Conversion Coatings from Sodium Nitroferricyanide and Potassium Ferricyanide Solutions Aluminum and aluminum alloy substrates were immersion-treated for 10 minutes at approximately 70° F. in the solutions shown in the following table:

| | A | B |
|---|---|---|
| $Na_2Cr_2O_7 . 2H_2O$ | 1.00 g. | 1.00 g. |
| $KF . 2H_2O$ | 0.10 g. | 0.10 g. |
| $Na_2Fe(CN)_5NO . 2H_2O$ | 0.10 g. | — |
| $K_3Fe(CN)_6$ | — | 0.10 g. |
| $H_2O$(dist), to make 100 ml. | → | → |
| $HNO_3$ (70%) to approx. pH 1.5 | 0.3 ml. | 0.3 ml. |

Number A substrates were uniformly coated with reflective, adherent, gold-colored reaction products, whereas number B coatings were matte, rust-colored with a non-adherent surface layer. Prior to the corrosion-resistance testing, both the A and B coatings were wet-rubbed with water; the number A specimens showed very little surface removal as compared to the number B specimens in which the excessive, and apparently more porous, build-up was easily removed. Corrosion protection to the base metals after total and partial immersion in sea water and 3% sodium chloride in tap water for greater than 3 months was very satisfactory, showing essentially no pitting; in contrast, Controls of the same metal substrates, that were not conversion-coating treated, were severely attacked, some within a couple of days.

EXAMPLE 2

Effect of Adding Sodium Vanadate 0.10 g. of sodium vanadate tetrahydrate ($NaVO_3\cdot4H_2O$) was added to each of the solutions of Example 1., and the tests were repeated with regard to observations of appearance and performance characteristics. It was discovered that the effects of the sodium vanadate were beneficial for each of the solutions, but more particularly for solution number B(containing the potassium ferricyanide) with regard to reducing the build-up of a loosely-adherent top layer; coatings from the number A-type solutions of Ex.1, remained esthetically acceptable and adherent, with indications of improved corrosion resistance.

I claim:

1. A method for imparting corrosion-resistant, tightly adherent, gold-colored, esthetically-appearing, chemically-bonded coatings to aluminum and its alloys, wherein aluminum is the principal constituent, by immersion of the metal substrate for 5 to 10 minutes at 65° to 85° F. in aqueous compositions consisting of: from 0.075 to 0.125 gm. of sodium nitroferricyanide dihydrate; a hexavalent chromium compound selected from the group consisting of from 0.75 to 1.25 gm. sodium dichromate dihydrate, 0.75 to 1.25 gm. anhydrous potassium dichromate, and 0.50 to 0.83 gm. chromium trioxide; an inorganic fluoride compound selected from the group consisting of 0.075 to 0.125 gm. potassium fluoride dihydrate, and 0.03 to 0.06 gm. anhydrous sodium fluoride; and 100 ml. of water with the solution adjusted to a pH of 1.4±0.3 with nitric acid, as required.

* * * * *